US006647693B2

(12) United States Patent
Bromberg

(10) Patent No.: US 6,647,693 B2
(45) Date of Patent: Nov. 18, 2003

(54) THREE-DIMENSIONAL STRUCTURES OF SHEET MATERIAL

(76) Inventor: Howard M. Bromberg, P.O. Box 316, Kingsbridge Station, Bronx, NY (US) 10463

( * ) Notice: Subject to any disclaimer, the term of this patent is extended or adjusted under 35 U.S.C. 154(b) by 0 days.

(21) Appl. No.: 10/099,837

(22) Filed: Mar. 15, 2002

(65) Prior Publication Data

US 2003/0172614 A1 Sep. 18, 2003

(51) Int. Cl.[7] ..... E04C 3/30

(52) U.S. Cl. ..... 52/732.2; 52/712; 52/731.2; 52/731.3; 446/76; 446/77; 403/354

(58) Field of Search ..... 52/732.2, 712, 52/714, 731.2, 731.3, 730.4, 732.1, 581, 581.1, 220.7; 108/115; 40/605, 124.19; 446/75, 76, 77, 122, 120; 220/23.4; 403/292, 194, 361, 354; 229/120.01, 120.03

(56) References Cited

U.S. PATENT DOCUMENTS

| | | | | | |
|---|---|---|---|---|---|
| 3,001,613 | A | * | 9/1961 | McBerty | 52/518 |
| 4,039,117 | A | * | 8/1977 | Sieffert | 52/220.7 |
| 4,841,882 | A | * | 6/1989 | Ehrman | 108/115 |
| 5,381,916 | A | * | 1/1995 | Strawder | 220/23.4 |
| 5,518,170 | A | * | 5/1996 | Rasmussen | 229/15 |
| 6,244,501 | B1 | * | 6/2001 | Choi | 229/120.01 |
| 6,402,414 | B1 | * | 6/2002 | Kanodia et al. | 403/230 |
| 6,410,844 | B1 | * | 6/2002 | Bruner et al. | 229/120.03 |

* cited by examiner

*Primary Examiner*—Carl D. Friedman
*Assistant Examiner*—Nahid Amiri
(74) *Attorney, Agent, or Firm*—Herbert Dubno

(57) ABSTRACT

A construction assembly in which a plurality of interconnected three-dimensional elements each has at least one wall and the elements are connected by loops or tongues of material of one element extending into windows of another element and held in place by pins of sheet material engaging through the loops and bearing upon the walls formed with the window from the side opposite that through which the loop was inserted.

18 Claims, 6 Drawing Sheets

THREE-DIMENSIONAL STRUCTURES OF SHEET MATERIAL

FIELD OF THE INVENTION

My present invention relates to three-dimensional structures of sheet material which may be used as construction toys, to erect displays, for packaging materials and for miniature and full-size construction, to kits from which three-dimensional structures may be created and to a linking system whereby three-dimensional structures be interconnected or parts of a single three-dimensional structure may be connected together.

While this invention may be described in connection with one or more of the uses mentioned and, in particular, as a construction toy, the principles of the invention are applicable widely to three-dimensional structures fabricated from sheet materials generally and can be used in all applications of such materials and in all applications in which three-dimensional structures can be erected from such materials.

The materials with which the invention is intended to be used are sheet materials which have a certain degree of flexibility and can be provided with bends or folds, although aspects of the invention can be used with sheet materials which are practically rigid and in which corners may be formed by providing film hinges or the like. The term "sheet material" is therefore intended to encompass both rigid and flexible materials to the extent that they are consistent with the applications described herein. Paper, paperboard, cardboard, laminated papers, plastic sheet, laminates of various plastic and coated paper, paperboard and like materials are those which the invention is principally used.

When reference is made here to construction toys, packaging materials, displays and structures generally, it is by way of example only and features described here, for example, as part of a construction toy, can be used for a display rack or case, for some other kind of structure, not necessarily in a miniature or flimsy form.

BACKGROUND OF THE INVENTION

Sheet materials have been assembled into utilitarian structures such as boxes and even articles of furniture, have been folded, die cut and connected to other elements by gluing, stapling and even by interlocking tabs, flanges or flaps with slits or slots inside any such sheet material.

In addition, construction toys and the like are known which have slots or slits opening at their edges and which are dimensioned to allow the slits of one piece to be fitted into slits of another and thus multiple pieces are assembled into relatively complex structures. The three-dimensional elements which are so formed can be flat or cylindrical and can be of rectangular, triangular or other polyhedral shapes. It is also known, for example, to thread one strip of sheet material through a slit formed in another to join those sheet material strips in a particular relationship.

While the number of applications that the assembly of sheet material into structures may have is countless and the ways in which sheet materials have been joined is diverse, there remains a need for a simple system for creating three-dimensional effects from sheet material and connecting three-dimensional articles which enables the assembly in a simple manner, is inexpensive and is versatile.

OBJECTS OF THE INVENTION

It is, therefore, the principal object of the present invention to provide a construction which satisfies the desiderata mentioned above and which can enable the formation of complex but stable three-dimensional structures starting from sheet material and especially sheet materials which are flexible, bendable and foldable without the drawbacks of earlier systems.

More specifically, it is an object of this invention to provide a three-dimensional structure which is of light weight, is easily assembled, can have its parts made available in a convenient package and is of low cost.

Another object of the invention is to provide a three-dimensional structure of improved versatility.

SUMMARY OF THE INVENTION

These objects and others which will become apparent hereinafter are attained, in accordance with the invention, utilizing a system for connecting different elements or parts of the same element and wherein a loop formed on one element or part is inserted through a window formed in another element or part and is held in place by a pin such that all of the components of the structure, namely, the first element or part, the second element or part and the pin are composed of the same sheet material and preferably separated from the same piece of material.

I have found that this is possible by providing the pin as a strip of the sheet material which is folded over and engaged in the aforementioned loop, by pressing the loop out from the sheet material of the first element after the latter has been inside with two parallel slits and by forming the window as a cutout in the sheet material.

The element formed with the lip may be folded or bent into three-dimensional shapes from the sheet material and the opposite edges of that element can be joined together, e.g. by interfitting slits. The pin may be folded into a dihedral form along a score line promoting the folding action and blanks of the sheet material may have two parts separated therefrom along respective score lines.

The loop itself may be formed at a corner of a three-dimensional shape folded from the sheet material and may represent a dihedron where it passes the window.

The three-dimensional element coupled in this manner can be folded from flat blanks to form the three-dimensional shapes and may be interfitted as in a construction toy.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
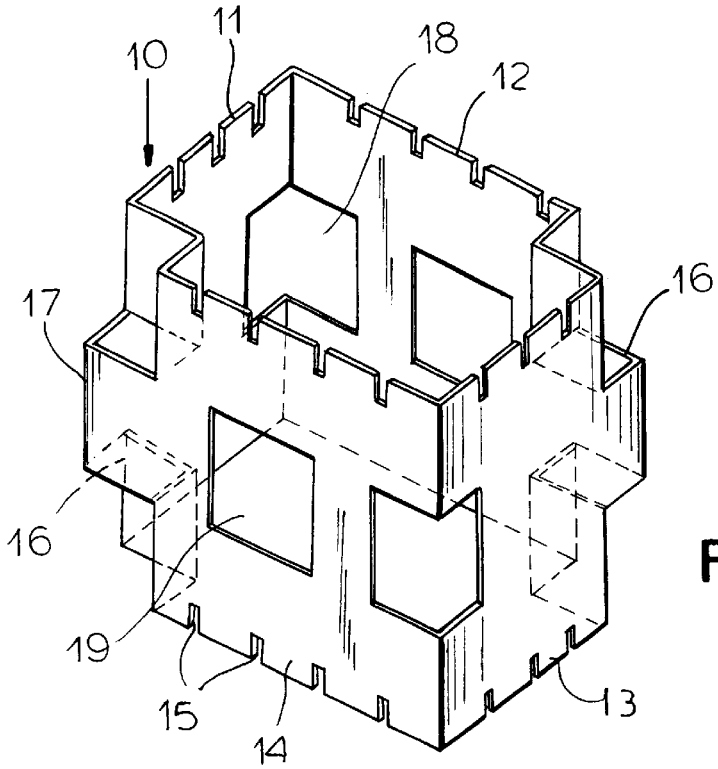
FIG. 1 is a perspective view illustrating a three-dimensional element fabricated from a sheet of material by bending it at score lines and gluing a flap thereof, the element being able to be interfitted with other elements which can be the same or different and which can have dihedral tongues fitting into windows of the element show.
Figure 2:
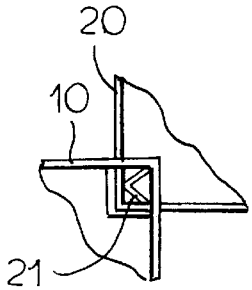
FIG. 2 is a plan view illustrating a corner connection of two elements similar to that of FIG. 1.

FIG. 1 shows a three-dimensional element 10 which is comprised of four walls 11, 12, 13, 14 which can be crenelated at the upper and lower edges, i.e. formed with slots 15 adapted to receive other structural elements with such slots such that the slots of two elements can interfit together. Such slotted construction toys are well known in the art. The three elements of the invention, unlike the rigid plastic slotted-edge elements known heretofore, can be fabricated entirely out of a flexible or semirigid material such as paper, paperboard or cardboard which can have a plastic coating, can be impregnated or coated with plastic or can be laminated to a plastic film. The construction element 10 can have one or more dihedral tongues 16, 17 which can be provided at corners of the element or elsewhere and is positioned and dimensioned to fit into windows 18, 19 which can be formed in accordance with wall panels of the element so that, as shown in FIG. 2, one of the tongues of one element 10 can fit into a window, e.g. the window 18 of another element 20 and the two can be held together by a "pin" formed by a strip of sheet material having at least one score or fold. The tongue and window assembly forms a triangular or rectangular channel receiving the pin inside the window. The pin may also be a tube which originally flat, can be expanded for insertion into the channel. The pin can be inserted flat or folded on one score to form an angle or on multiple scores to form a triangle or rectangle.

Figure 3:
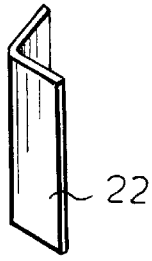
FIGS. 3 and 4 are views of pins which can be used for securing the three-dimensional elements together.
Figure 4:
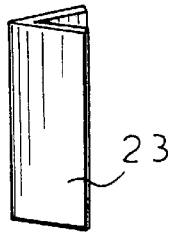
Figure 5:
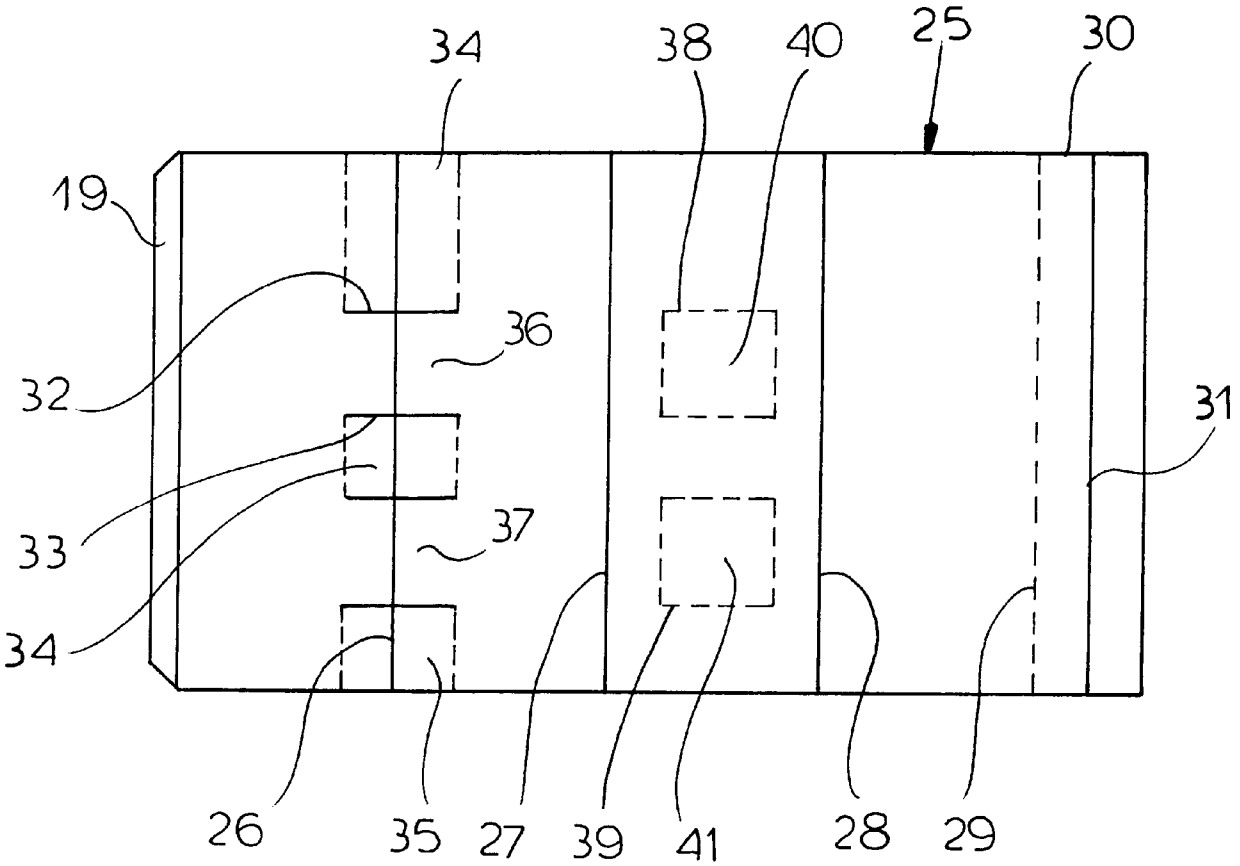
FIG. 5 is a plan view of a blank which can be used to produce an element and pin in accordance with the invention.

The pin 21 seen in FIG. 2 can be spread apart as shown at 22 in FIG. 3 or folded together as shown at 23 in FIG. 4. The three-dimensional element and the pin may be made available in the form of a die cut or stamped blank 25 (FIG. 5) which is scored at 26, 27 and 28 to provide bend lines and is incised at 29 to allow the strip 30 to be separated from the remainder of the blank and then folded along a score line 31 to form one of the pins 21, 22, 23. The blank 25 is also incised at 32 and 33 to allow segments 34 and 35 to be pressed out of a corner region formed at the fold or score line 26 so that dihedral tongues 36 and 37 can be formed along that corner. The blank may also be scored at 38 and 39 to allow the pieces 40 and 41 to be pressed out to form windows, whereby dihedral tongues of a similar element can be inserted and held in place by a respective pin 21, 22 or 23.

Figure 6:
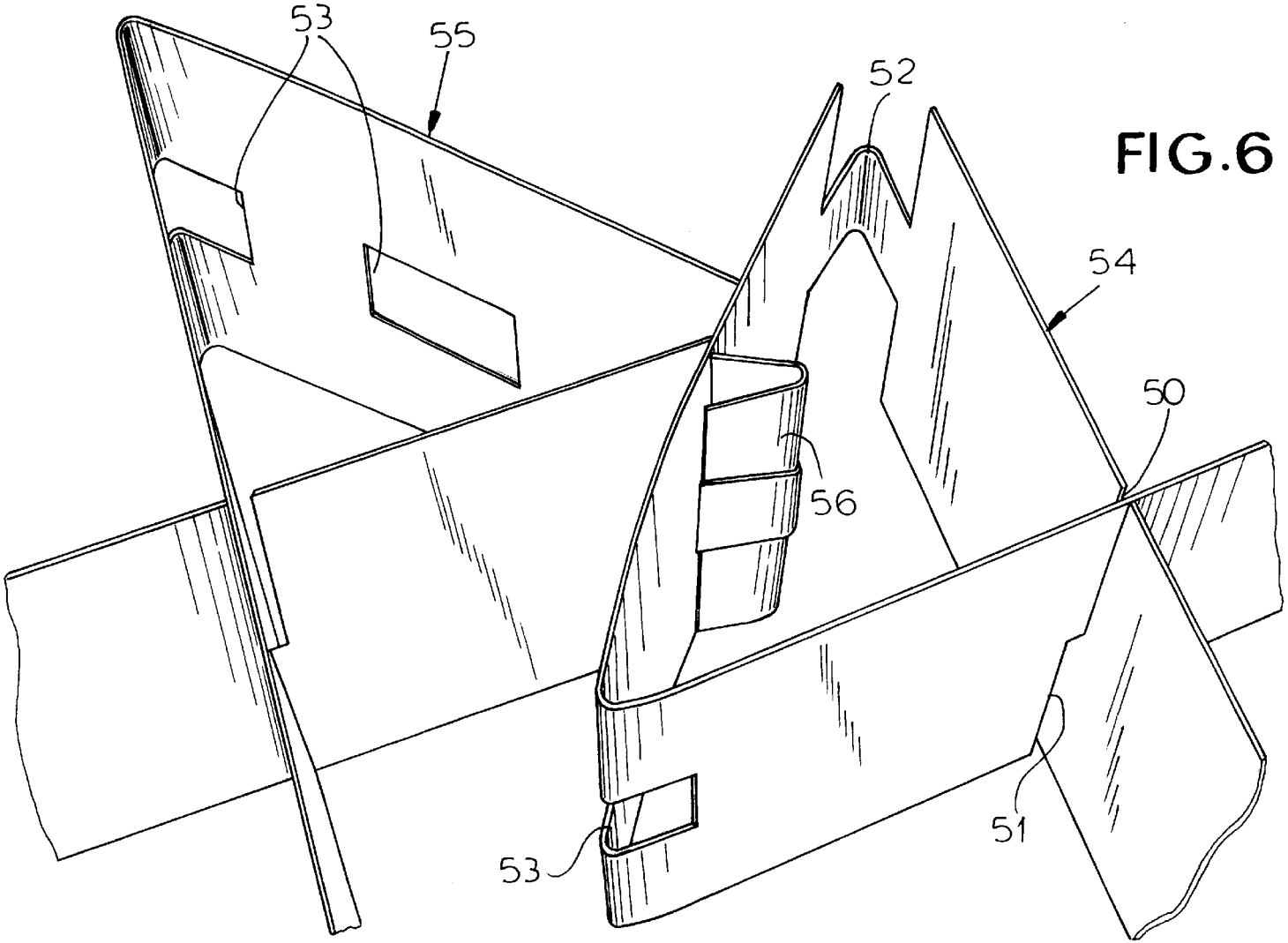
FIG. 6 is a perspective view of a construction assembly illustrating the principle of the invention.

As can be seen from FIG. 6, a rectangular configuration is not necessary and FIG. 6 shows a triangular pattern formed by locking the sheet material at interengaging slots 50 and 51. Dihedral tongues 52 and windows 53 are provided in the elements 54 and 55 shown in FIG. 6 and folded pin 56 engages as tongue fitting through a window to lock them together.

Figure 8:
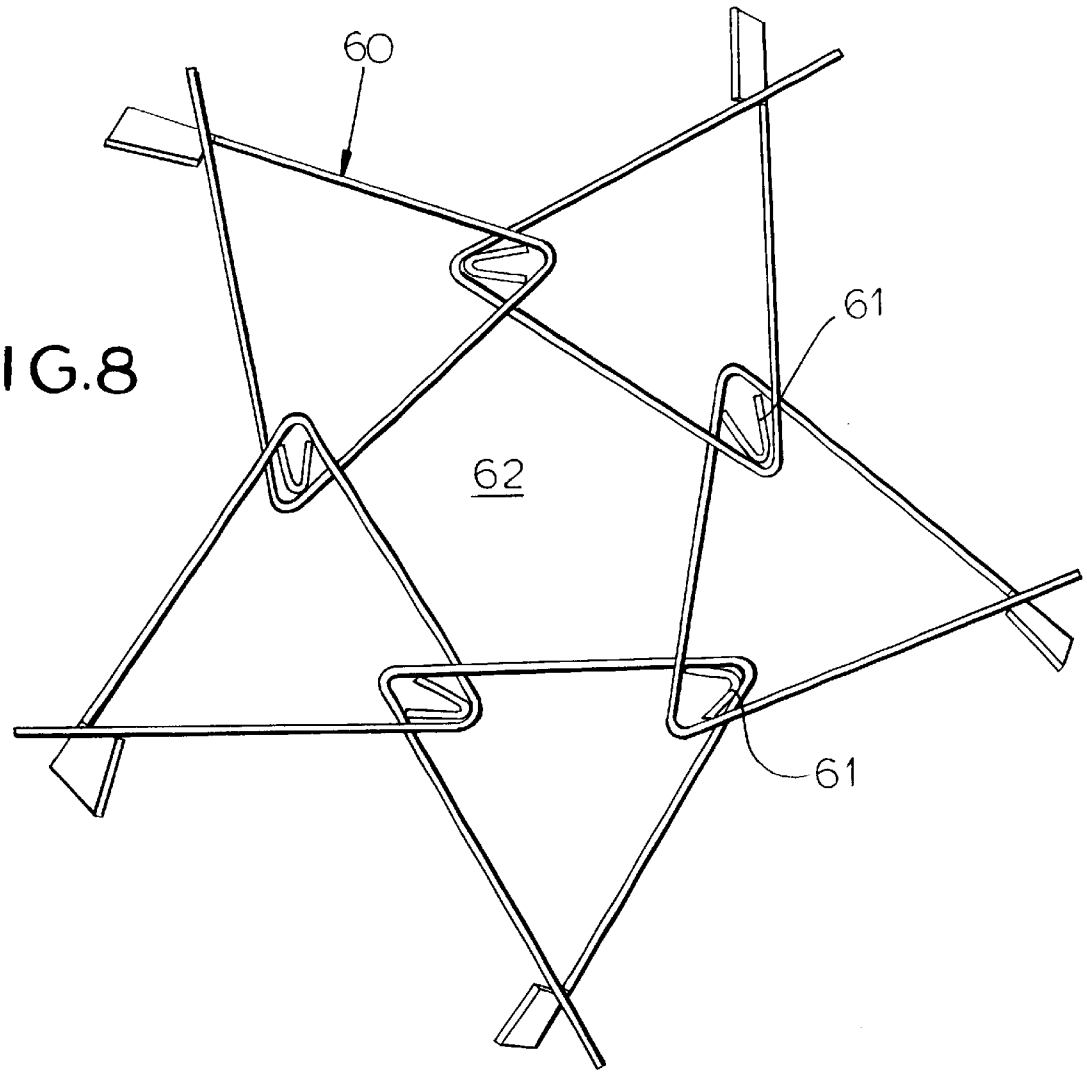
FIG. 8 is a plan view showing yet another layout of construction elements of the type shown in FIG. 6.

FIG. 8 shows a pattern which can be made with triangular elements of this type both as a load-bearing structure and as a toy or the like. In FIG. 8, five triangular elements 60 are locked together with pins 61 where the tongues fit through the windows to provide a pentagonal center portion 62. In the embodiments of FIGS. 6 and 8, the elements are fitted together after bending from the platform, by interengaging slots whereas in FIG. 1 and for the blank of FIG. 5, flaps 19 are provided and can be glued to an opposing wall element to retain the three-dimensional shape.

Figure 7:
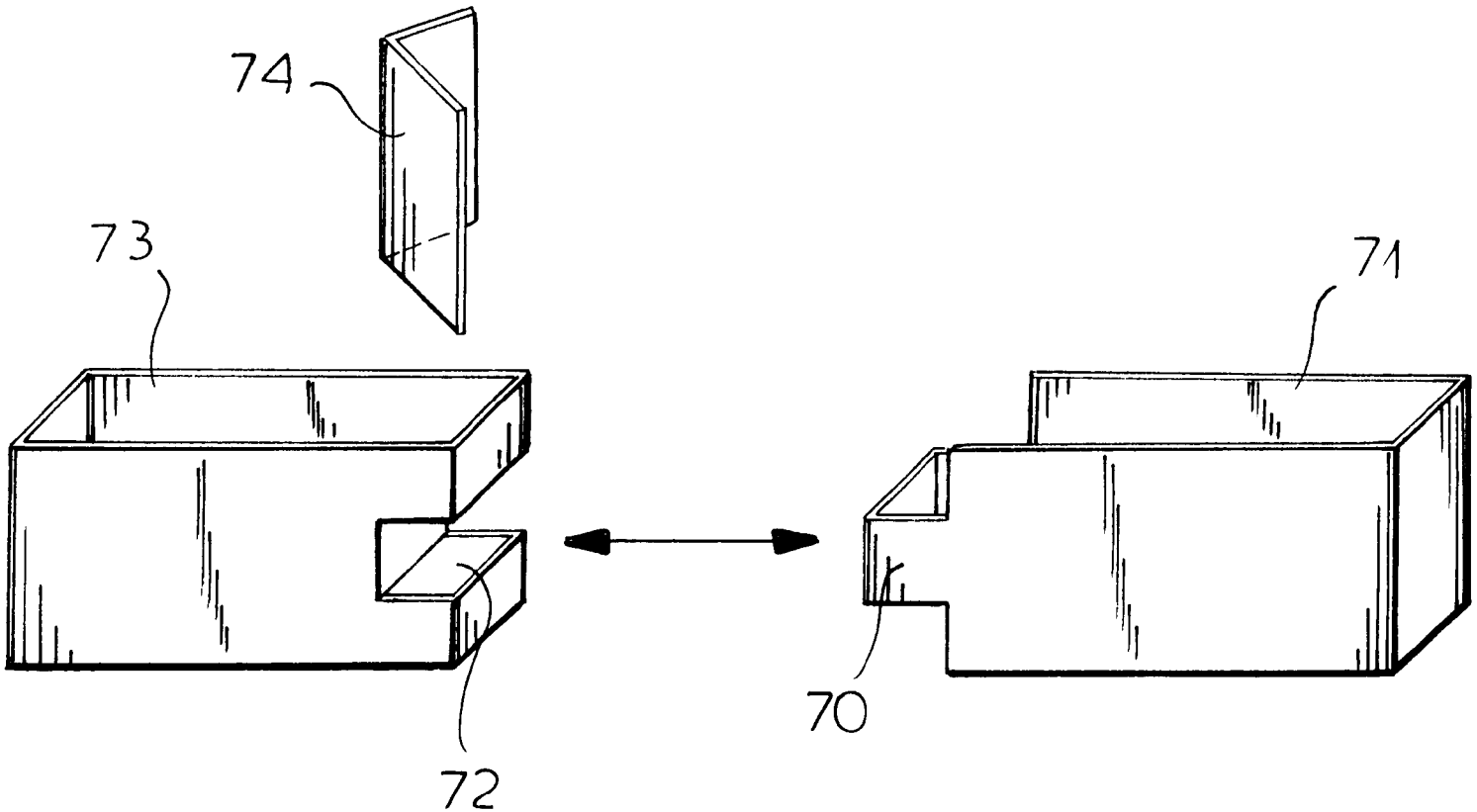
FIG. 7 is a diagram illustrating another construction according to the invention in an assembly diagram.

FIG.7 shows a rectangular assembly of different proportions and one wherein the tongue 70 of element 71 is not a dihedral but rather is a rectangular member which is received in the opening 72 of element 73 so that a folded pin 74 can be inserted to retain the parts together.

Figure 9:
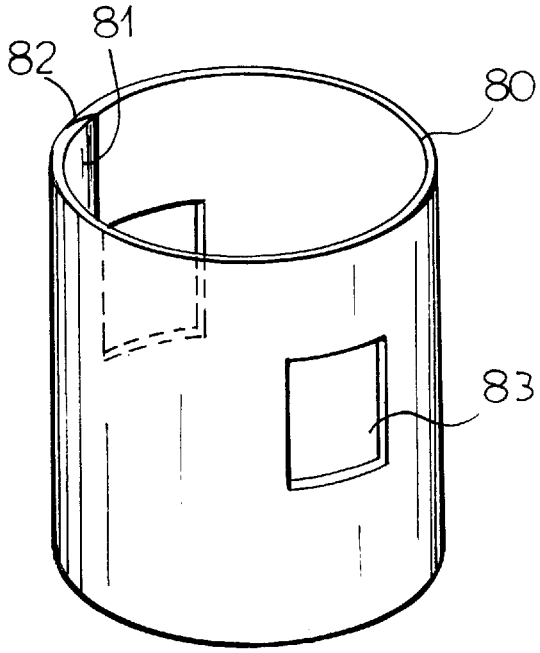
FIG. 9 is a perspective view illustrating another construction element which can be assembled together with that of FIG. 1 or one of the other construction elements shown in other Figures.

A cylindrical element (FIG. 9) can also be bent from the flat blank and can have a flap 81 which is glued at 82 to the opposite end of the member forming cylinder 80. The latter can have windows 83 receiving the tongues 70 or 16 for example of other elements and which is then secured by a folded or flat pin. Where the tongue is rounded and the window is in a cylinder, they form an ovoid channel receiving the pin.

Figure 10:
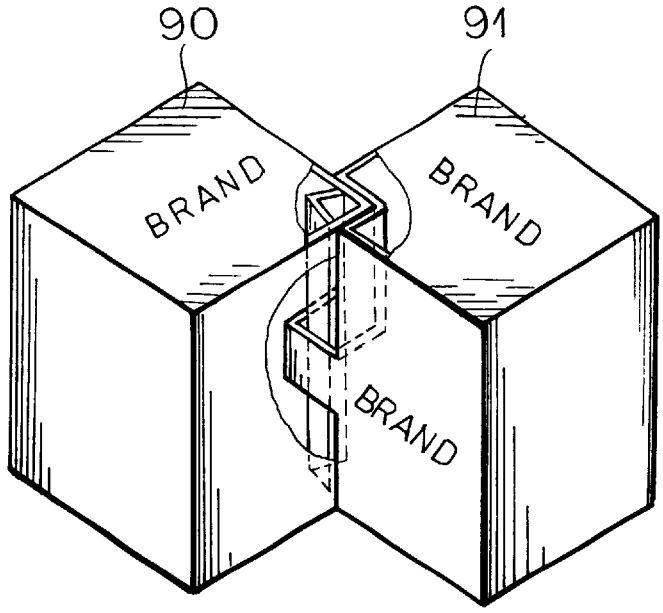
FIG. 10 is a perspective view showing a point-of-sale display which can be fabricated as a construction assembly according to this invention.

FIG. 10 shows that the three-dimensional elements 90 and 91 may be simulated cartons for a product, the cartons being joined by a folded or flat pin as has been described in connection with FIG. 2 to form, for example, a point-of-sale display for the particular brand of the product intended to be contained therein.

I claim:

1. A three-dimensional structure comprising at least one element formed of a flexible sheet material and formed with at least one loop delimited between a pair of spaced-apart slits in said sheet material and extending from one side of a sheet material through a window therein to project on an opposite side of the sheet material provided with said window, and a pin extending transversely through said loop on said opposite side.

2. The three-dimensional structure defined in claim 1 wherein said window is formed in said at least one element.

3. The three-dimensional structure defined in claim 1 wherein said window is formed in another element separate from said at least one element.

4. The three-dimensional structure defined in claim 1 wherein both of said elements are separated from a single piece of die-cut sheet material.

5. The three-dimensional structure defined in claim 4 wherein said pin is a folded strip of said sheet material separated from said piece.

6. The three-dimensional structure defined in claim 1 wherein said pin is a strip of sheet material.

7. The three-dimensional structure defined in claim 1 wherein said element is bent from a single piece of sheet material and has opposite edges interconnected with one another.

8. The three-dimensional structure defined in claim 7 wherein said edges are formed with slits enabling said edges to engage in one another.

9. A construction assembly comprising at least one three-dimensional element composed of paper or paperboard and connected to at least one other element of paper or paperboard, said three-dimensional element having a dihedral tongue formed at a corner thereof, said other element having a window receiving said tongue and formed in a wall or corner of said other element, and a pin formed by a folded paper or paperboard strip fitting into said dihedral tongue within said other element to secure said elements together.

10. The construction assembly defined in claim 4 wherein said window has a generally rectangular configuration.

11. The construction assembly defined in claim 10 wherein at least one of said walls is formed with a respective said window spaced inwardly of corners adjoining said at least one of said walls.

12. The construction assembly defined in claim 10 wherein said window is formed at one of said corners which does not have a respective dihedral tongue.

13. The construction assembly defined in claim 10 wherein each said elements has four walls and four corners interconnecting said walls of each element.

14. The construction assembly defined in claim 10 wherein the assembly is comprised of at least three interconnected elements wherein each of said elements has at least one said window and at least one said tongue at a corner thereof.

15. The construction assembly defined in claim 10 wherein each of said elements has at least two of said tongues and at least two of said windows.

16. The construction assembly defined in claim 10 wherein said elements are die cut blanks of a web of paper or paperboard folded and erected into hollow structures, said pin being cut from said web.

17. The construction assembly defined in claim 9 as a package, construction toy, exhibit, display, playhouse, trellis, fence, screen, partition, or modular structure.

18. A construction assembly comprising a plurality of interconnected three-dimensional elements each bent or folded from a blank of die cut sheet material into a column shape and having at least one wall, one of said elements having a rectangular window, the other of said elements having a corner formed with a dihedral tongue projecting through said window; a pin fitting into said dihedral tongue within said one of said elements to secure said elements together; and slits formed along edges of said elements to permit interconnection of said elements with other elements of sheet material.

* * * * *